US012528568B2

(12) United States Patent
Huang et al.

(10) Patent No.: US 12,528,568 B2
(45) Date of Patent: Jan. 20, 2026

(54) BIOMIMETIC FISH

(71) Applicant: Pioneer Material Precision Tech Co., Ltd., New Taipei (TW)

(72) Inventors: Wei-Yu Huang, New Taipei (TW); Tai-Yu Chen, New Taipei (TW); Li-Yuan Yeh, New Taipei (TW); Chang-Qi Zhang, New Taipei (TW); Ching-Hung Liu, New Taipei (TW); Chih-Wei Shen, New Taipei (TW)

(73) Assignee: PIONEER MATERIAL PRECISION TECH CO., LTD., New Taipei (TW)

( * ) Notice: Subject to any disclaimer, the term of this patent is extended or adjusted under 35 U.S.C. 154(b) by 397 days.

(21) Appl. No.: 18/467,691

(22) Filed: Sep. 14, 2023

(65) Prior Publication Data

US 2024/0417048 A1 Dec. 19, 2024

(30) Foreign Application Priority Data

Jun. 15, 2023 (TW) ..... 112122465

(51) Int. Cl.
*B63G 8/00* (2006.01)
*B63G 8/04* (2006.01)

(52) U.S. Cl.
CPC ..... *B63G 8/001* (2013.01); *B63G 8/04* (2013.01); *B63G 2008/002* (2013.01)

(58) Field of Classification Search
CPC ..... B63G 8/001; B63G 8/24; B63G 2008/002
See application file for complete search history.

(56) References Cited

U.S. PATENT DOCUMENTS 2,936,729 A * 5/1960 Kuttner ..... B63H 1/36 440/15
6,138,604 A * 10/2000 Anderson ..... B63G 8/08 440/15
6,619,146 B2 * 9/2003 Kerrebrock ..... F16H 21/52 74/25

(Continued)

FOREIGN PATENT DOCUMENTS

CN 113525638 B * 4/2022 ..... B63G 8/26
CN 114954863 B * 9/2024 ..... B63G 8/39

(Continued)

*Primary Examiner* — S. Joseph Morano
*Assistant Examiner* — Jovon E Hayes
(74) *Attorney, Agent, or Firm* — HSML P.C.

(57) ABSTRACT

A biomimetic fish includes a cover structure and two housing bodies arranged in a front-rear direction, connected to each other, and rotatable relative to each other about a rotating axis that extends in an up-down direction. The cover structure includes first and second cover portions respectively formed on the housing bodies. The first cover portion has two distal end parts disposed at a distal end thereof and arranged in a left-right direction. The second cover portion has two arcuate outer surfaces respectively adjacent to the distal end parts and each having a center of curvature located on the rotating axis. At least one of the arcuate outer surfaces is connected to the respective one of the distal end parts. An intersection of the arcuate outer surfaces and the respective one of the distal end parts is located at an inner side of the respective one of the distal end parts.

8 Claims, 10 Drawing Sheets

(56) References Cited

U.S. PATENT DOCUMENTS

| | | | | |
|---|---|---|---|---|
| 6,814,634 | B2 * | 11/2004 | Roberts | B63H 11/08 440/38 |
| 6,835,108 | B1 * | 12/2004 | Gieseke | B63H 1/30 440/14 |
| 8,322,296 | B2 * | 12/2012 | Tiraby | B63G 8/20 114/337 |
| 9,937,986 | B1 * | 4/2018 | Oh | B63G 8/001 |
| 2022/0033043 | A1 * | 2/2022 | Garthwaite | B63H 1/36 |

FOREIGN PATENT DOCUMENTS

| | | | | |
|---|---|---|---|---|
| CN | 119568377 | A * | 3/2025 | G01C 11/00 |
| CN | 119568454 | A * | 3/2025 | B64U 30/12 |
| CN | 116331453 | B * | 8/2025 | B63G 8/38 |
| DE | 202024102869 | U1 * | 7/2024 | B63G 8/14 |

* cited by examiner

BIOMIMETIC FISH

CROSS-REFERENCE TO RELATED APPLICATION

This application claims priority to Taiwanese Invention Patent Application No. 112122465, filed on Jun. 15, 2023 and incorporated by reference herein in its entirety.

FIELD

The disclosure relates to a biomimetic fish, and more particularly to a biomimetic fish including at least two housing bodies

BACKGROUND

To perform movement that mimics fish swimming, a conventional biomimetic fish usually includes a plurality of articulated joints that are made of relatively hard materials, such as plastic or metal. In order to prevent the articulated joints from interfering each other during movement thereof, it is necessary to design a receiving space in the conventional biomimetic fish for accommodating each of the articulated joints. However, such design may cause steps, gaps, depressions, or unevenness in an appearance of the conventional biomimetic fish. Consequently, when the conventional biomimetic fish moves, especially when the conventional biomimetic fish is in a bent state, the conventional biomimetic fish appears stiff and unnatural.

SUMMARY

Therefore, an object of the disclosure is to provide a biomimetic fish that can alleviate at least one of the drawbacks of the prior art.

According to an aspect of the disclosure, a biomimetic fish is provided and includes an outer housing that includes at least two housing bodies and at least one cover structure. The at least two housing bodies are arranged in a front-rear direction, are connected to each other, and are rotatable relative to each other about a rotating axis that extends in an up-down direction perpendicular to the front-rear direction. The at least one cover structure is disposed at a junction of the housing bodies, and includes a first cover portion and a second cover portion. The first cover portion is formed on one of the housing bodies, and has two distal end parts disposed at a distal end thereof and arranged in a left-right direction that is perpendicular to the front-rear direction and the up-down direction. The second cover portion is formed on the other one of the housing bodies, has two arcuate outer surfaces arranged in the left-right direction, and are respectively adjacent to the distal end parts. The center of curvature of each of the arcuate outer surfaces is located on the rotating axis. At least one of the arcuate outer surfaces is connected to the respective one of the distal end parts. An intersection of the at least one of the arcuate outer surfaces and the respective one of the distal end parts is located at an inner side of the respective one of the distal end parts.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
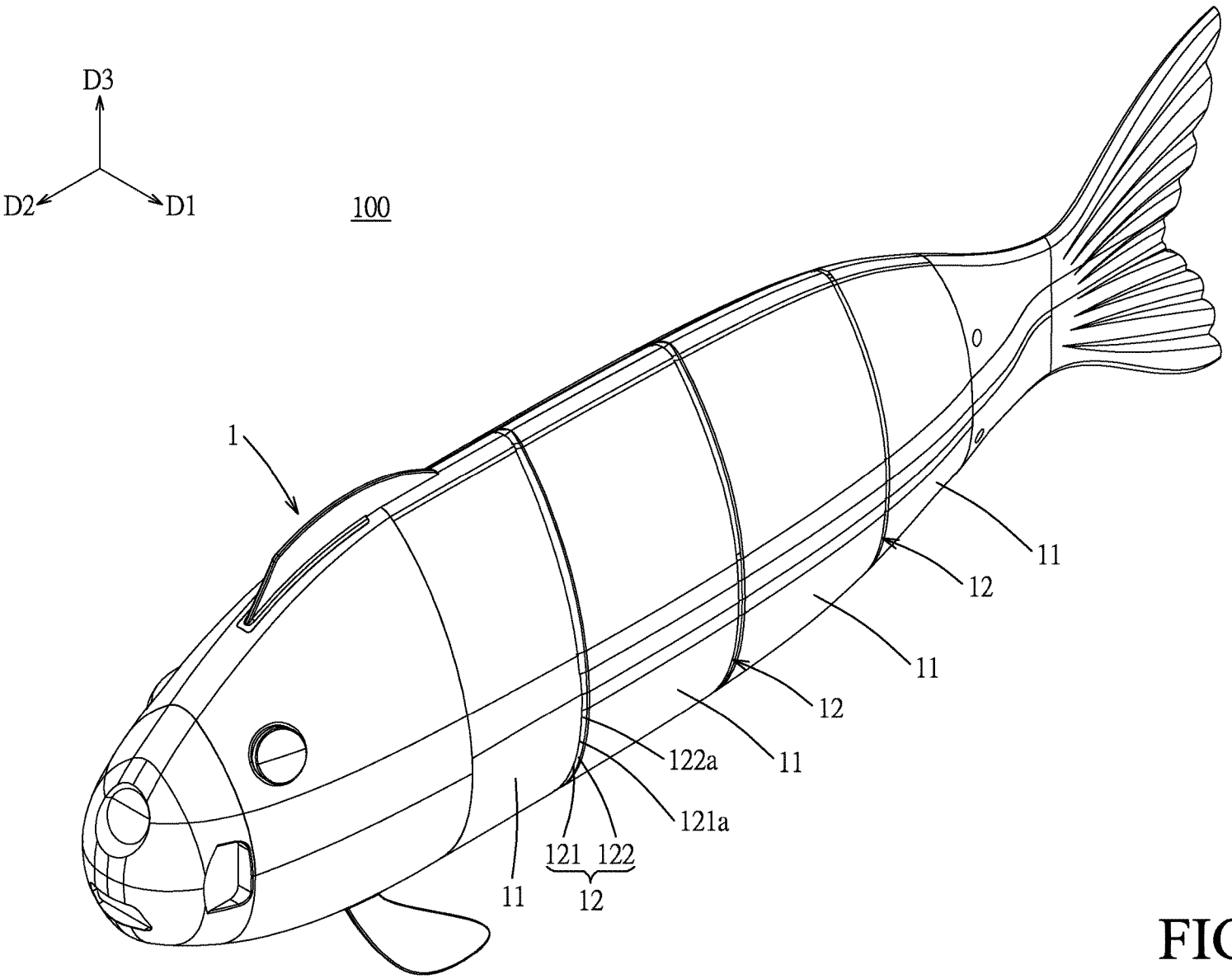
FIG. 1 is a perspective view of an embodiment of a biomimetic fish according to the present disclosure, illustrating an outer housing of the embodiment being in an initial state.
Figure 2:
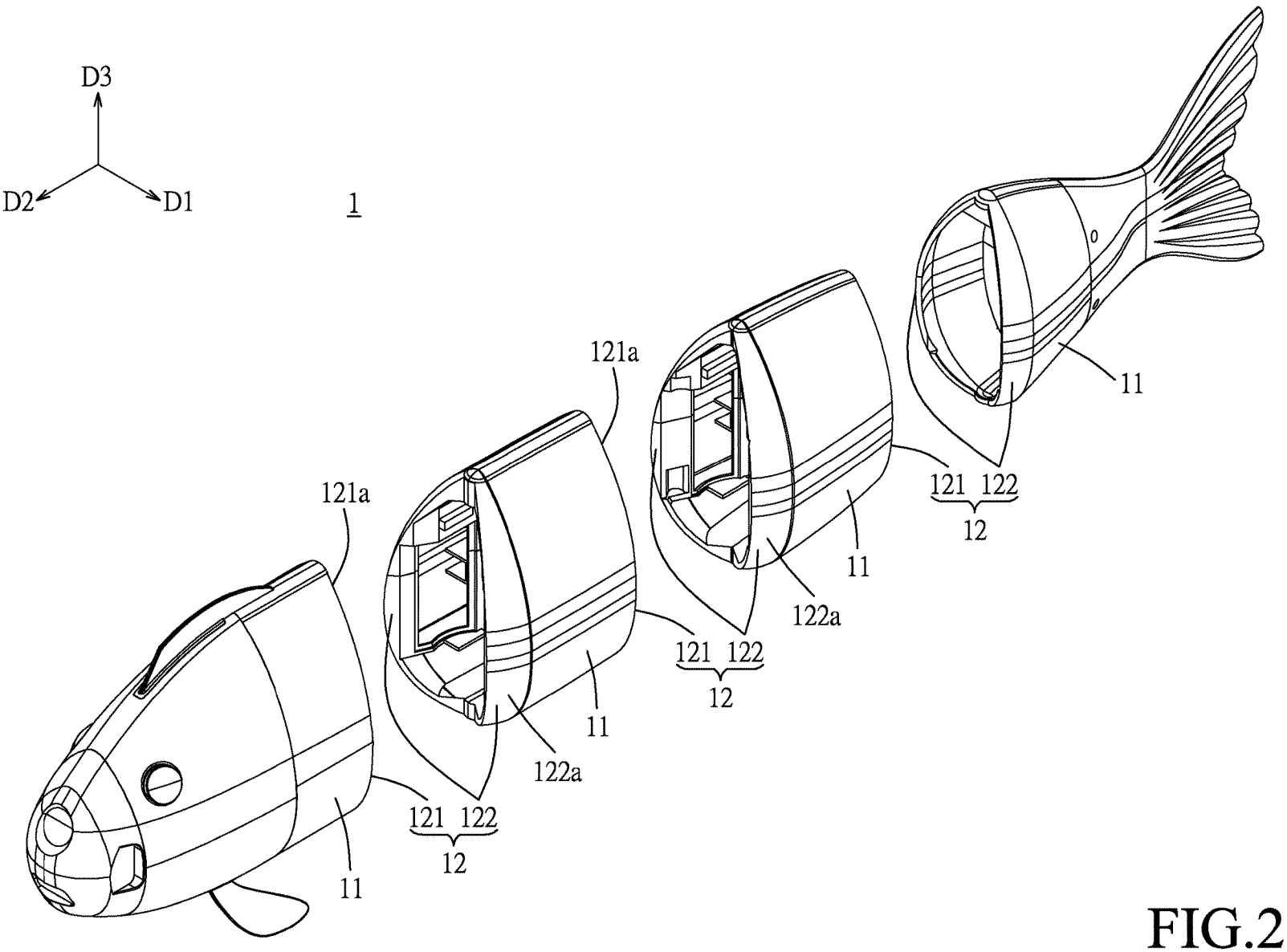
FIG. 2 is a partly exploded perspective view of the outer housing of the embodiment.
Figure 3:
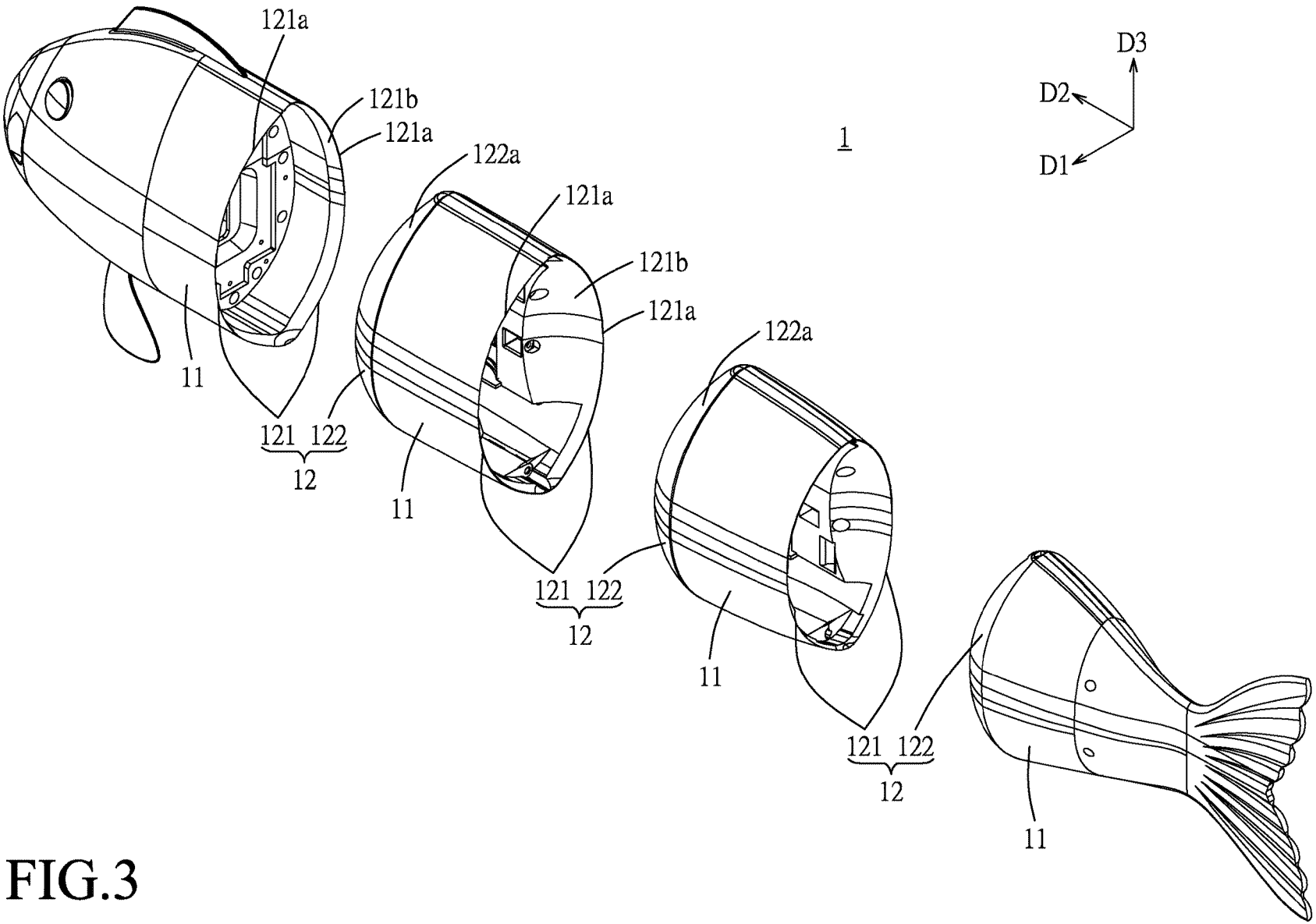
FIG. 3 is a partly exploded perspective view, illustrating the outer housing of the embodiment from another view of angle different from FIG. 2.
Figure 4:
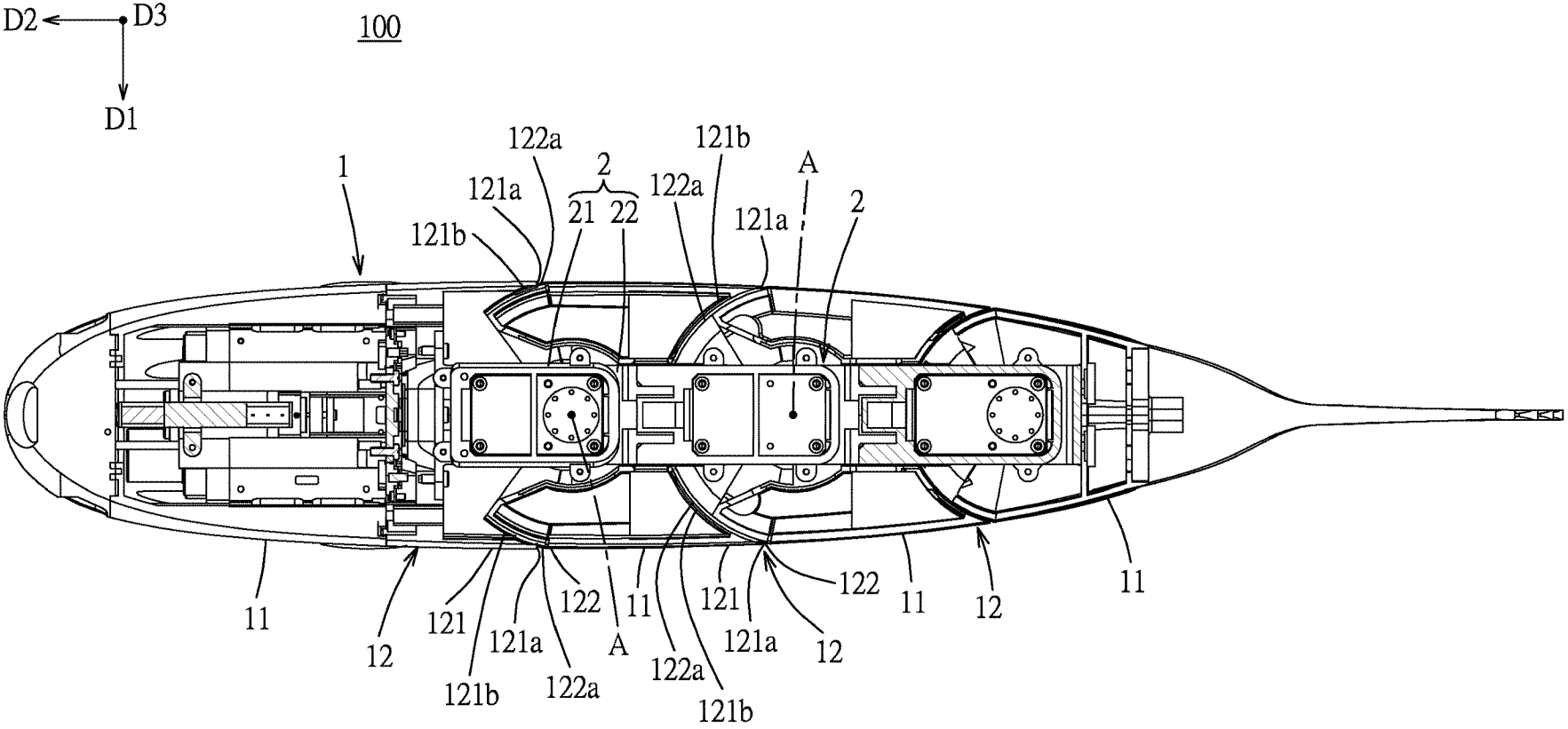
FIG. 4 is a sectional top view of the embodiment of FIG. 1.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Referring to FIGS. 1 to 4, an embodiment of the biomimetic fish 100 of the present disclosure includes an outer housing 1 and a plurality of rotating mechanisms 2 mounted in the outer housing 1. The outer housing 1 is substantially symmetric with respect to an axis extending in a front-rear direction (D2), and may be made of a material such as plastic or metal. The outer housing 1 includes a plurality of housing bodies 11 connected to each other and arranged in the front-rear direction (D2), and a plurality of cover structures 12 each disposed at a junction between a respective pair of the housing bodies 11. Each of the rotating mechanisms 2 is disposed between and interconnects a respective pair of the housing bodies 11, so that the respective pair of the housing bodies 11 are connected to each other and are rotatable relative to each other about a rotating axis (A) that extends in an up-down direction (D3) perpendicular to the front-rear direction (D2). Each of the rotating mechanisms 2 includes a fixing portion 21 disposed on a front one of the respective pair of the housing bodies 11, and a rotating portion 22 disposed on the rear one of the respective pair of the housing bodies 11 and rotatable relative to the fixing portion 21 about the rotating axis (A). The rotating portion 22 of each of the rotating mechanisms 2 may be driven by an electronic component such as a motor (not shown) to rotate relative to the fixing portion 21.

Since the structure of each of the cover structures 12 and each of the housing bodies 11 is identical, only one of the cover structures 12 and the respective pair of the housing bodies 11 will be described in the following description for the sake of brevity. The cover structure 12 includes a first cover portion 121 that is formed at a rear end of the front one of the housing bodies 11 and a second cover portion 122 that is formed at a front end of the rear one of the housing bodies 11. The first cover portion 121 has two distal end parts 121*a* disposed at a distal end thereof and arranged in a left-right direction (D1) perpendicular to the front-rear direction (D2) and the up-down direction (D3), and two arcuate inner surfaces 121*b* respectively connected to the distal end parts 121*a*, arranged in the left-right direction (D1), and extending respectively and forwardly from the distal end parts 121*a*. The second cover portion 122 has two arcuate outer surfaces 122*a* arranged in the left-right direction (D1), respectively adjacent to the distal end parts 121*a*, and being located at a front side of the rotating axis (A) in the front-rear direction (D2). A center of curvature of each of the arcuate outer surfaces 122*a* is located on the rotating axis (A). The arcuate inner surfaces 121*b* correspond respectively in shape with the arcuate outer surfaces 122*a*. At least one of the arcuate outer surfaces 122*a* is connected to the respective one of the distal end parts 121*a* and faces the respective one of the distal end parts 121*a*. It should be noted that in other embodiments, the first cover portion 121 may be formed at a front end of the rear one of the housing bodies 11 and the second cover portion 122 may be formed at a rear end of the front one of the housing bodies 11.

The outer housing 1 is movable between an initial state (see FIG. 1) and a bent state (see FIGS. 8 to 10) through relative rotation between the housing bodies 11. The outer housing 1 moves to a transitional state (see FIG. 5) when moving between the initial state and the bent state. It should be noted that the outer housing 1 may be bent to the left and the right in the left-right direction (D1), for the sake of simplicity, in the following description, the outer housing 1 will be described to be bent in only one direction.

An intersection of the at least one of the arcuate outer surfaces 122*a* and the respective one of the distal end parts 121*a* is located at an inner side of the respective one of the distal end parts 121*a*. When the outer housing 1 is in the initial state, the outer housing 1 extends substantially straight in the front-rear direction (D2), one of the housing bodies 11 is parallel to the other one of the housing bodies 11, the arcuate outer surfaces 122*a* are connected respectively to the distal end parts 121*a*, and the intersection of each of the two arcuate outer surfaces 122*a* and the respective one of the distal end parts 121*a* is located at an inner side of the respective one of the distal end parts 121*a*.

Figure 5:
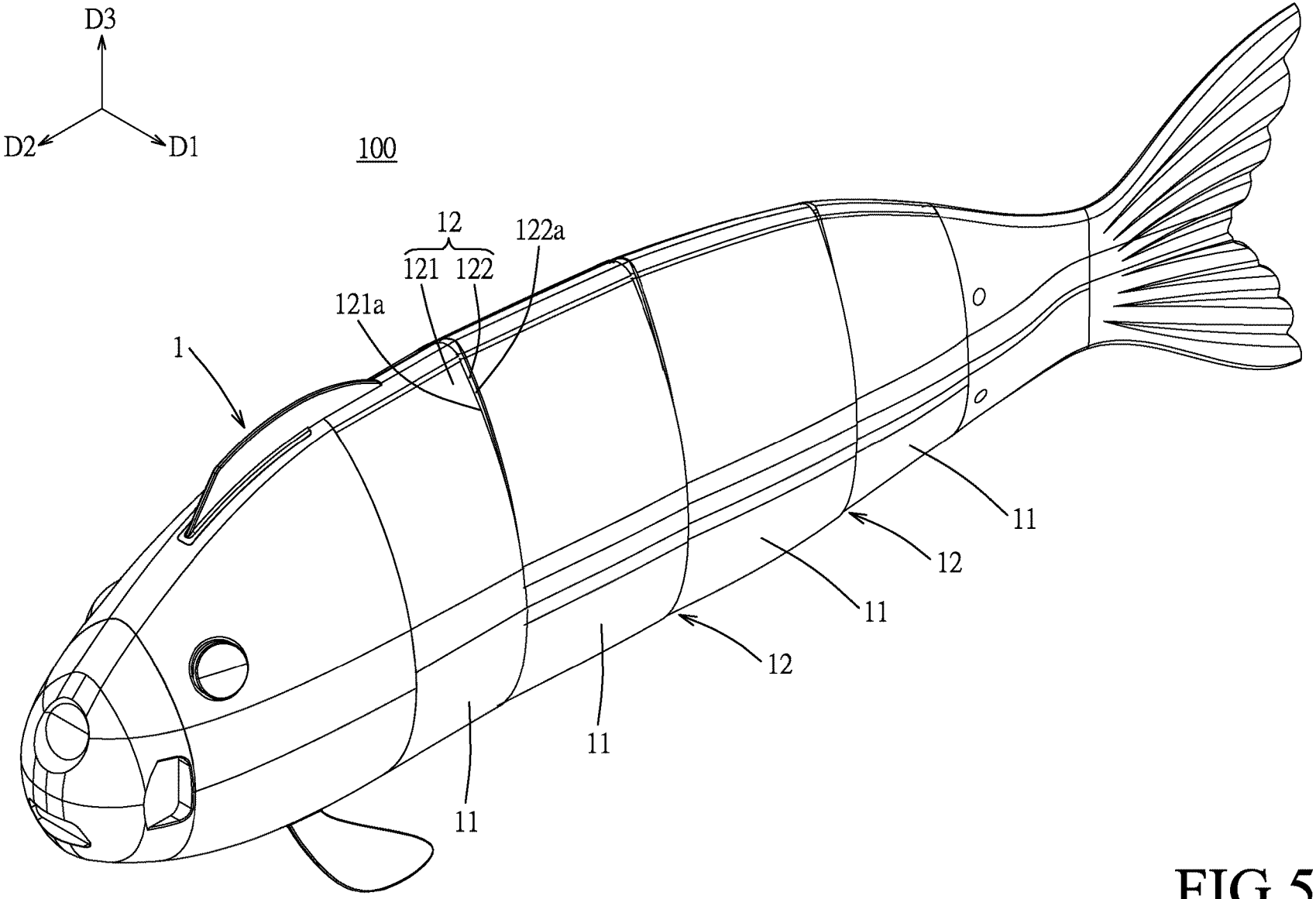
FIG. 5 is a perspective view of the embodiment, illustrating the outer housing being in a transitional state.
Figure 6:
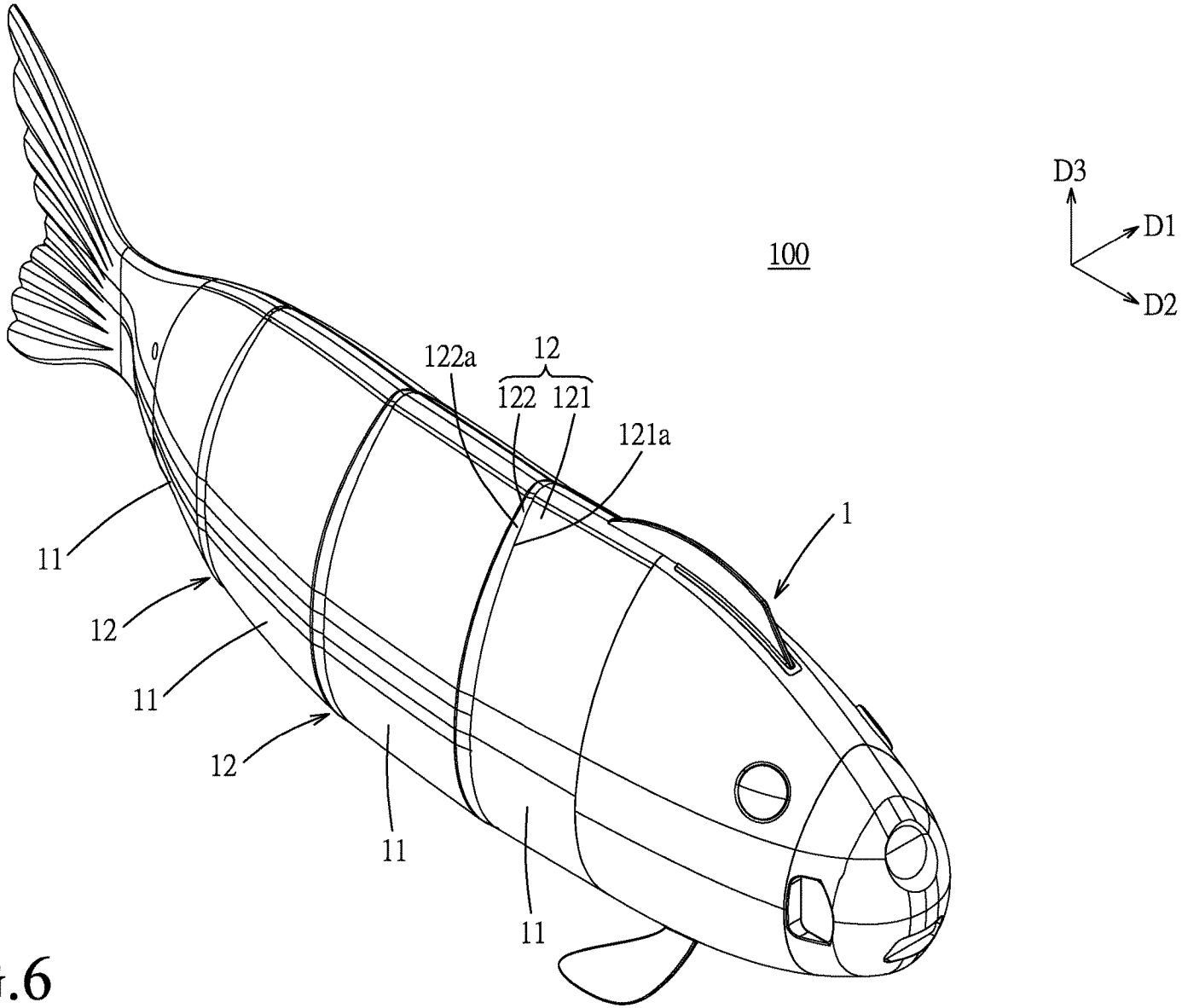
FIG. 6 is a perspective view of the embodiment, illustrating the outer housing of the embodiment in the transitional state from another view of angle different from FIG. 5.
Figure 7:
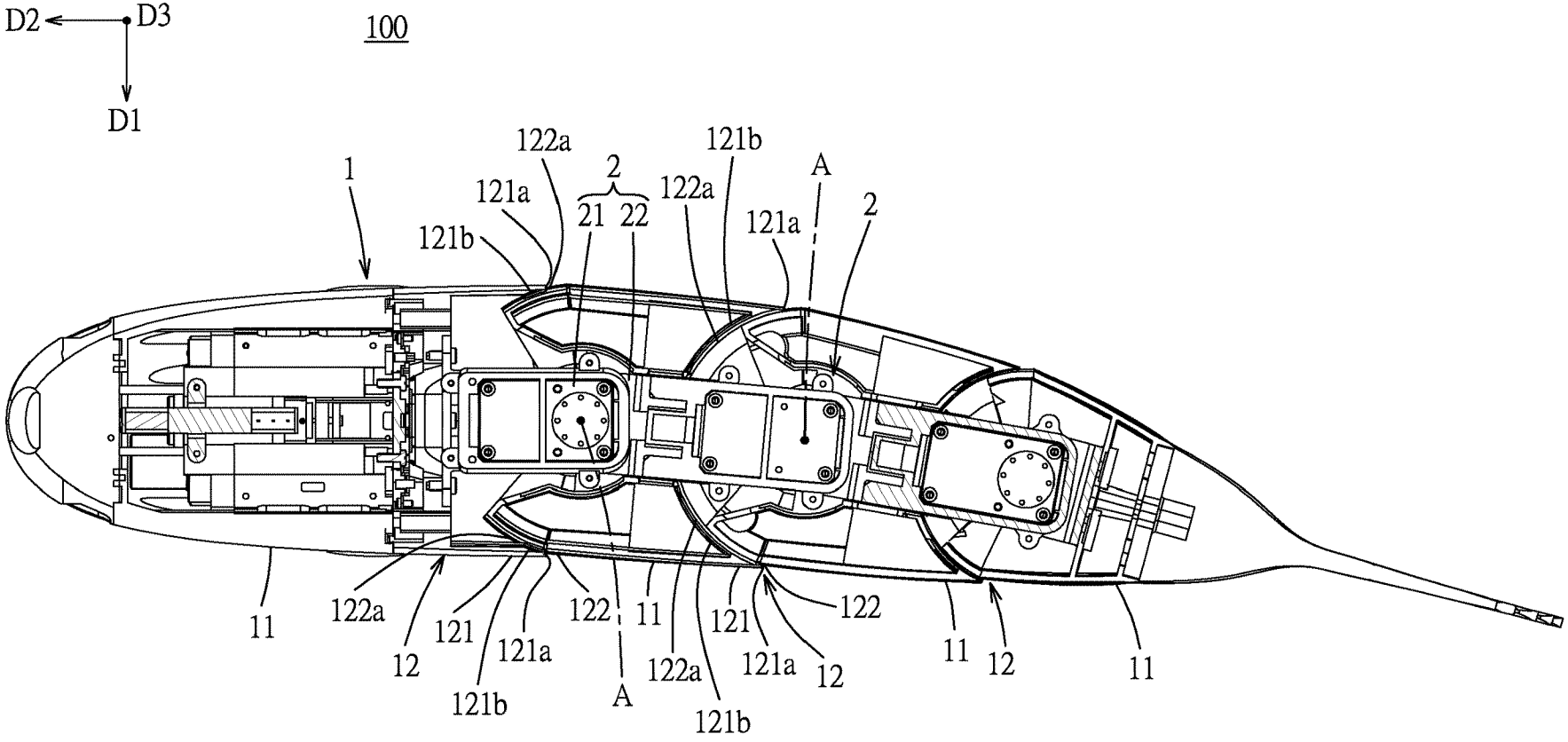
FIG. 7 is a sectional top view of the embodiment of FIG. 5.

Referring to FIGS. 5 to 7, when the outer housing 1 is in the transitional state, i.e., the outer housing 1 is slightly bent, one of the housing bodies 11 is inclined relative to the other one of the housing bodies 11, the arcuate outer surfaces 122*a* are connected respectively to the distal end parts 121*a*, and the intersection of each of the two arcuate outer surfaces 122*a* and the respective one of the distal end parts 121*a* is located at an inner side of the respective one of the distal end parts 121*a*.

Figure 8:
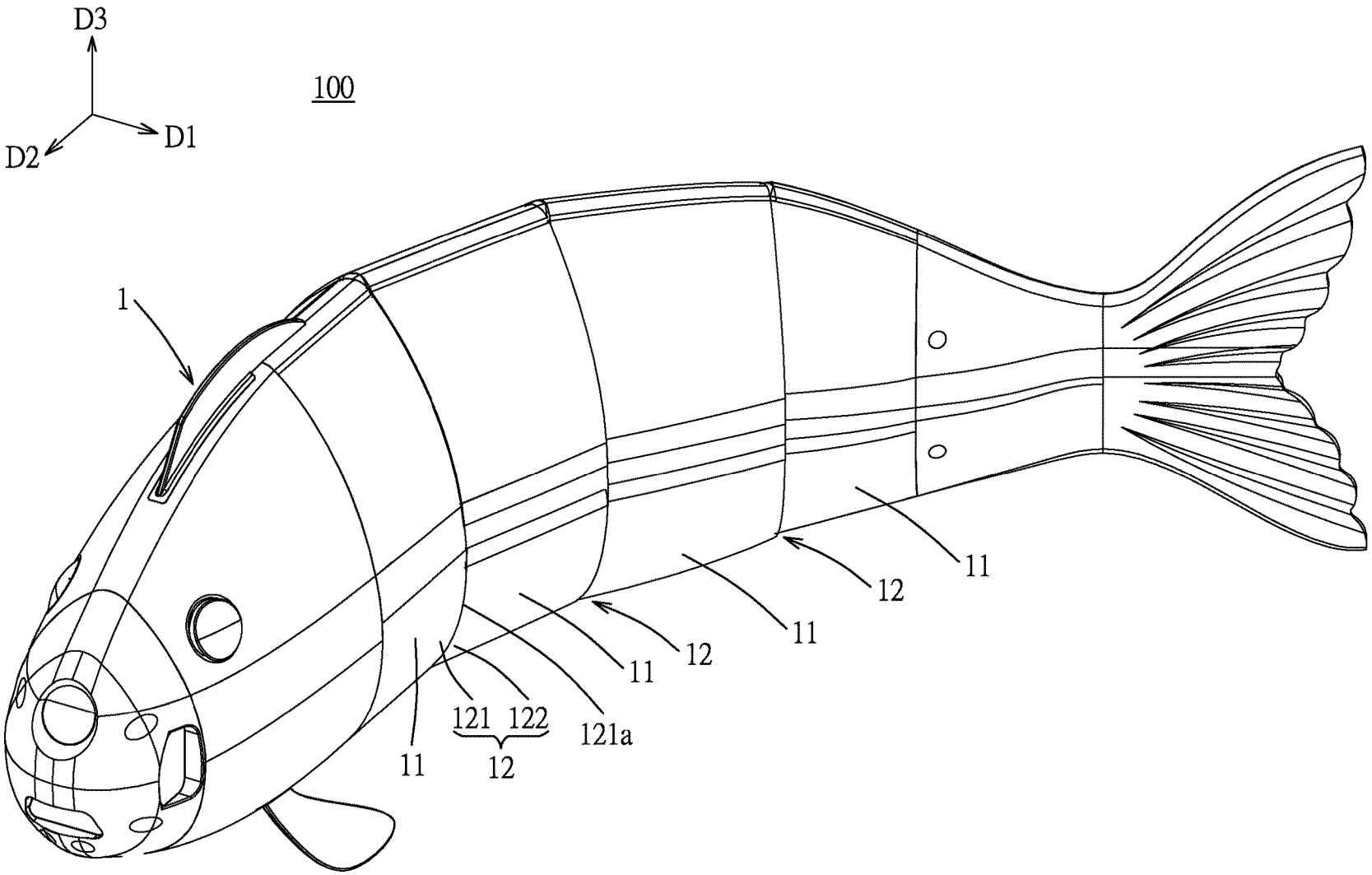
FIG. 8 is a perspective view of the embodiment, illustrating the outer housing of the embodiment being in a bent state.
Figure 9:
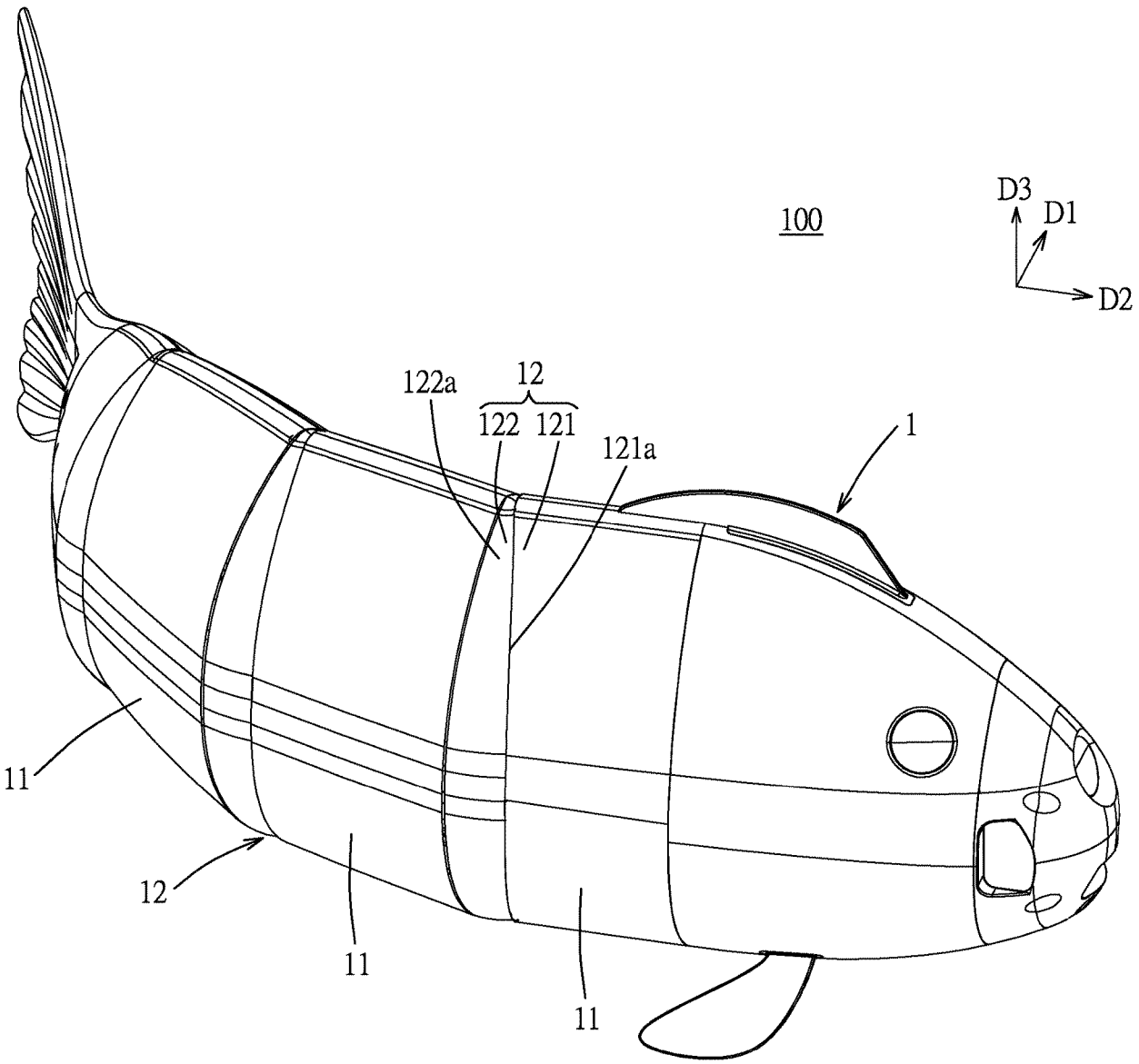
FIG. 9 is a perspective view of the embodiment, illustrating the outer housing of the embodiment being in the bent state from another view angle different from FIG. 8.
Figure 10:
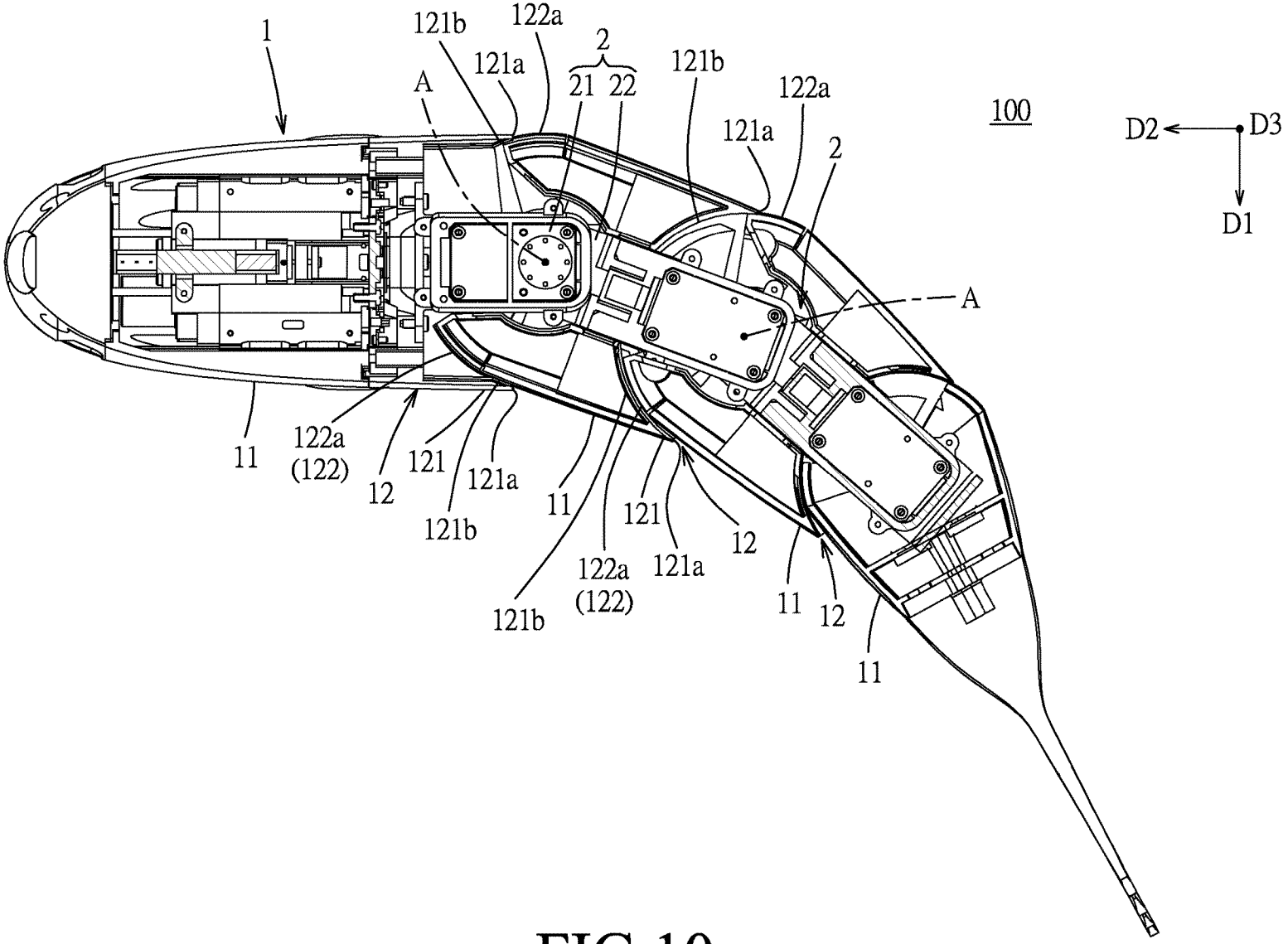
FIG. 10 is a sectional top view of the embodiment of FIG. 8.

Referring to FIGS. 8 to 10, when the outer housing 1 is in the bent state, i.e., the outer housing 1 is bent to its limit, an outer one of the arcuate outer surfaces 122*a* (see the upper one of the arcuate outer surfaces 122*a* in FIG. 10) is connected to the respective one of the distal end parts 121*a*, and the intersection of the outer one of the arcuate outer surfaces 122*a* and the respective one of the distal end parts 121*a* is located at an inner side of the respective one of the distal end parts 121*a*. As shown in FIG. 10, an outer surface of the rear one of the housing bodies 11 is connected to the lower one of the distal end parts 121*a*.

In summary, by virtue of the intersection of the at least one of the arcuate outer surfaces 122*a* of the second cover portion 122 and the respective one of the distal end parts 121*a* of the first cover portion 121 being located at an inner side of the respective one of the distal end parts 121*a*, unevenness at a junction between the respective pair of the housing bodies 11 of the outer housing 1 may be reduced and a more smooth appearance of the biomimetic fish may be provided. Additionally, since the arcuate outer surfaces 122*a* of the second cover portion 122 are curved, steps, gaps, depressions, or unevenness at the junction between respective pair of the housing bodies 11 of the biomimetic fish of the present disclosure are less likely to occur, so the appearance of the biomimetic fish 100 during movement thereof may be more natural.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A biomimetic fish comprising an outer housing that includes:

at least two housing bodies arranged in a front-rear direction, connected to each other, and rotatable relative to each other about a rotating axis that extends in an up-down direction perpendicular to the front-rear direction; and at least one cover structure disposed at a junction of said housing bodies and including a first cover portion that is formed on one of said housing bodies, and that has two distal end parts disposed at a distal end thereof and arranged in a left-right direction that is perpendicular to the front-rear direction and the up-down direction, and a second cover portion that is formed on the other one of said housing bodies, that has two arcuate outer surfaces arranged in the left-right direction and respectively adjacent to said distal end parts;

wherein a center of curvature of each of said arcuate outer surfaces is located on said rotating axis; and wherein at least one of said arcuate outer surfaces is connected to the respective one of said distal end parts; and wherein an intersection of said at least one of said arcuate outer surfaces and the respective one of said distal end parts is located at an inner side of the respective one of said distal end parts.

2. The biomimetic fish as claimed in claim 1, wherein said first cover portion further has two arcuate inner surfaces respectively connected to said distal end parts, arranged in the left-right direction, and corresponding respectively in shape with said arcuate outer surfaces (122*a*), said at least one of said arcuate outer surfaces facing the respective one of said distal end parts.

3. The biomimetic fish as claimed in claim 1, wherein:

said first cover portion is formed at a rear end of a front one of said housing bodies in the front-rear direction;

said second cover portion is formed at a front end of a rear one of said housing bodies in the front-rear direction; and said arcuate outer surfaces of said second over portion are located at a front side of the rotating axis in the front-rear direction.

4. The biomimetic fish as claimed in claim 1, wherein:

said at least two outer housing includes at least three housing bodies; and said at least one cover structure includes at least two cover structures each disposed at a junction between a respective pair of said housing bodies.

5. The biomimetic fish as claimed in claim 1, wherein said biomimetic fish further comprises a rotating mechanism disposed between said housing bodies and interconnecting said housing bodies such that said housing bodies are rotatable relative to each other about the rotating axis.

6. The biomimetic fish as claimed in claim 5, wherein said rotating mechanism includes:

a fixing portion disposed on a front one of said housing bodies in the front-rear direction; and a rotating portion disposed on a rear one of said housing bodies in the front-rear direction, connected to said fixing portion, and rotatable relative to said fixing portion about the rotating axis.

7. The biomimetic fish as claimed in claim 1, wherein:

said outer housing is movable between an initial state and a bent state through relative rotation between the housing bodies;

when said outer housing is in the initial state, one of said housing bodies is parallel to the other one of said housing bodies, said arcuate outer surfaces are connected respectively to said distal end parts, and said intersection of each of said two arcuate outer surfaces and the respective one of said distal end parts is located at an inner side of the respective one of said distal end parts; and when said outer housing is in the bent state, one of said housing bodies is inclined relative to the other one of said housing bodies, an outer one of said arcuate outer surfaces is connected to the respective one of said distal end parts, and said intersection of said outer one of said arcuate outer surfaces and the respective one of said distal end parts is located at an inner side of the respective one of said distal end parts.

8. The biomimetic fish as claimed in claim 7, wherein:

said outer housing moves to a transitional state when moving between the initial state and the bent state;

when said outer housing is in the transitional state, one of said housing bodies is inclined relative to the other one of said housing bodies, said arcuate outer surfaces are connected respectively to said distal end parts, and said intersection of each of said arcuate outer surfaces and the respective one of said distal end parts is located at an inner side of the respective one of said two distal end parts.

* * * * *